US011098550B2

(12) United States Patent
Givens et al.

(10) Patent No.: US 11,098,550 B2
(45) Date of Patent: Aug. 24, 2021

(54) BLOWOUT PREVENTER WITH WIDE FLANGE BODY

(71) Applicant: Cameron International Corporation, Houston, TX (US)

(72) Inventors: Matthew D. Givens, Houston, TX (US); Christopher J. Nault, Houston, TX (US); Darrin L. Yenzer, Cypress, TX (US); Ray Cummins, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 154 days.

(21) Appl. No.: 15/581,539

(22) Filed: Apr. 28, 2017

(65) Prior Publication Data

US 2017/0314358 A1 Nov. 2, 2017

Related U.S. Application Data

(60) Provisional application No. 62/330,835, filed on May 2, 2016.

(51) Int. Cl.
*E21B 33/03* (2006.01)
*E21B 33/038* (2006.01)
(Continued)

(52) U.S. Cl.
CPC ..... *E21B 33/038* (2013.01); *E21B 33/0355* (2013.01); *E21B 33/061* (2013.01);
(Continued)

(58) Field of Classification Search
CPC ..... E21B 33/06; E21B 33/061; E21B 33/062; E21B 33/038; E21B 33/0355; E21B 33/063; E21B 33/064
See application file for complete search history.

(56) References Cited

U.S. PATENT DOCUMENTS 2,193,110 A 3/1940 Penick
2,357,411 A 9/1944 Leman
(Continued)

FOREIGN PATENT DOCUMENTS

CN 203603818 U 5/2014
CN 204552679 U 8/2015
(Continued)

OTHER PUBLICATIONS

International Search Report and Written Opinion for corresponding Application No. PCT/US2017/030090, dated Sep. 13, 2017, 16 pages.
(Continued)

*Primary Examiner* — Christopher J Sebesta

(57) ABSTRACT

Blowout preventers having bodies without flanged necks are provided. In one embodiment, a blowout preventer stack includes first and second blowout preventers having independent and separable main bodies, each including a bore and a ram cavity transverse to the bore. The lower end of the main body of the first blowout preventer is fastened directly to an upper end of the main body of the second blowout preventer without a flanged neck extending the bore between the ram cavities of the first and second blowout preventers. In some instances, the main bodies of the first and second blowout preventers include external connection flanges that extend laterally from ram cavity body portions of the main bodies so as to enable connection of the two main bodies along the sides of the main bodies away from their bores. Additional systems, devices, and methods are also disclosed.

14 Claims, 16 Drawing Sheets

(51) Int. Cl.
*E21B 33/06* (2006.01)
*E21B 33/035* (2006.01)
*E21B 33/064* (2006.01)

(52) U.S. Cl.
CPC ..... *E21B 33/062* (2013.01); *E21B 33/063* (2013.01); *E21B 33/064* (2013.01)

(56) References Cited

U.S. PATENT DOCUMENTS

| | | | | |
|---|---|---|---|---|
| 2,517,821 | A | 8/1950 | Herbert | |
| 2,749,078 | A * | 6/1956 | Losey | E21B 33/062 277/325 |
| 2,912,214 | A * | 11/1959 | Allen | E21B 33/062 251/1.3 |
| 4,304,310 | A * | 12/1981 | Garrett | E21B 33/085 166/84.3 |
| 4,470,621 | A | 9/1984 | Irvine | |
| 4,508,313 | A | 4/1985 | Jones | |
| 4,580,628 | A | 4/1986 | Schaeper | |
| 4,589,625 | A * | 5/1986 | Jones | E21B 33/062 251/1.3 |
| 4,690,221 | A | 9/1987 | Ritter, Jr. | |
| 5,544,707 | A | 8/1996 | Hopper et al. | |
| 5,897,094 | A * | 4/1999 | Brugman | E21B 33/062 251/1.1 |
| 5,975,484 | A | 11/1999 | Brugman et al. | |
| 6,142,236 | A | 11/2000 | Brammer et al. | |
| 6,296,225 | B1 | 10/2001 | Watts | |
| 6,848,539 | B2 | 2/2005 | Lee et al. | |
| 7,175,626 | B2 | 2/2007 | Neff | |
| 10,107,062 | B2 | 10/2018 | Roesner et al. | |
| 2003/0136927 | A1 | 7/2003 | Baugh | |
| 2004/0074635 | A1 | 4/2004 | Collie et al. | |
| 2004/0101384 | A1 | 5/2004 | Schilling et al. | |
| 2004/0256107 | A1 | 12/2004 | Adams et al. | |
| 2006/0000992 | A1 | 1/2006 | Springett et al. | |
| 2009/0294129 | A1 | 12/2009 | Judge et al. | |
| 2011/0304138 | A1* | 12/2011 | Commoner | F16L 23/032 285/368 |
| 2012/0103630 | A1 | 5/2012 | Parlee | |
| 2013/0168075 | A1 | 7/2013 | Shah et al. | |
| 2013/0283919 | A1* | 10/2013 | Coonrod | E21B 33/0355 73/632 |
| 2013/0287499 | A1 | 10/2013 | Fraczek et al. | |
| 2014/0020905 | A1 | 1/2014 | Chen et al. | |
| 2014/0034293 | A1* | 2/2014 | Jahnke | E21B 33/062 166/86.3 |
| 2014/0034393 | A1 | 2/2014 | Mitjans et al. | |
| 2014/0174754 | A1 | 6/2014 | Smith | |
| 2014/0183382 | A1 | 7/2014 | Carbaugh et al. | |
| 2015/0176744 | A1 | 6/2015 | Glassman et al. | |
| 2015/0315867 | A1 | 11/2015 | Caldwell et al. | |
| 2015/0361755 | A1 | 12/2015 | Holland, Jr. | |
| 2017/0067583 | A1 | 3/2017 | Illakowicz et al. | |
| 2017/0314358 | A1 | 11/2017 | Givens et al. | |
| 2019/0093438 | A1 | 3/2019 | Givens et al. | |
| 2019/0128085 | A1 | 5/2019 | Givens et al. | |

FOREIGN PATENT DOCUMENTS

| | | | |
|---|---|---|---|
| CN | 204944764 | U | 1/2016 |
| GB | 480817 | A | 3/1938 |
| WO | 2004-059118 | A1 | 7/2004 |
| WO | 2012078780 | A2 | 6/2012 |

OTHER PUBLICATIONS

International Search Report and Written Opinion for related Application No. PCT/PCT/US2017/030106, dated Sep. 13, 2017, 18 pages.

International Search Report and Written Opinion for related Application No. PCT/PCT/US2017/030099, dated Jul. 25, 2017, 12 pages.

International Preliminary Report on Patentability for the equivalent International patent application PCT/US2017/030090 dated Nov. 15, 2018.

International Preliminary Report on Patentability for the cross referenced International patent application PCT/US2017/030099 dated Nov. 15, 2018.

International Preliminary Report on Patentability for the cross referenced International patent application PCT/US2017/030106 dated Nov. 15, 2018.

* cited by examiner

BLOWOUT PREVENTER WITH WIDE FLANGE BODY

CROSS REFERENCE PARAGRAPH

This application claims the benefit of U.S. Provisional Application No. 62/330,835, entitled "BLOWOUT PREVENTER WITH WIDE FLANGE BODY," filed May 2, 2016, the disclosure of which is hereby incorporated herein by reference

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Further, such systems generally include a wellhead assembly through which the resource is accessed or extracted. These wellhead assemblies may include a wide variety of components, such as various casings, valves, fluid conduits, and the like, that control drilling or production operations. More particularly, wellhead assemblies often include blowout preventers, such as a ram-type preventer that uses one or more pairs of opposing rams to restrict flow of fluid through the blowout preventer or to shear through a drill string or another object within the blowout preventer. Multiple blowout preventers can be assembled in a blowout preventer stack for use at a well.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to blowout preventers having external connection flanges along the sides of ram cavity body portions to facilitate connection of the blowout preventers to other components. In at least some embodiments, these external connection flanges are provided as part of a wide flange preventer body and allow vertical bore API connections to be omitted from a blowout preventer. This, in turn, allows a reduction in the height of the blowout preventer and in blowout preventer stacks having such a preventer. In some other embodiments, the main body of a blowout preventer includes internal choke and kill line pass-through conduits. Multiple blowout preventers with these internal conduits can be aligned with one another in a blowout preventer stack to form shared choke and kill line conduits extending internally through the blowout preventers. The internal choke and kill line pass-through conduits can be provided in a blowout preventer body with or without vertical bore API connections.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
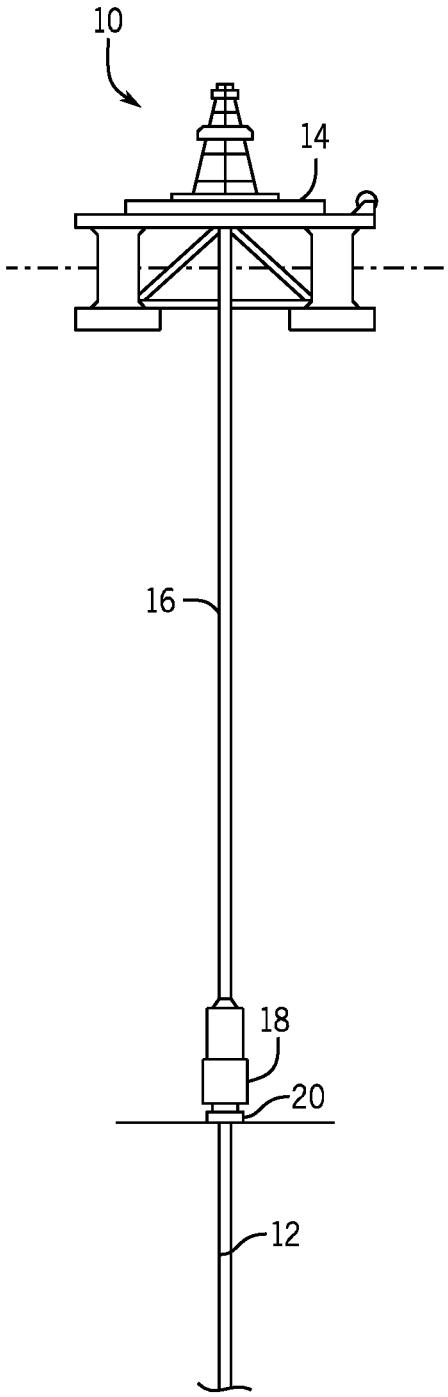
FIG. 1 generally depicts a well apparatus in the form of an offshore drilling system with a drilling rig coupled by a riser to a wellhead assembly in accordance with one embodiment of the present disclosure.

Turning now to the present figures, a well assembly or apparatus 10 is illustrated in FIG. 1 in accordance with one embodiment. The apparatus 10 (e.g., a drilling system or a production system) facilitates access to or extraction of a resource, such as oil or natural gas, from a reservoir through a well 12. The apparatus 10 is generally depicted in FIG. 1 as an offshore drilling apparatus including a drilling rig 14 coupled with a riser 16 to a wellhead assembly 18 installed at the well 12. Although shown here as an offshore system, the well apparatus 10 could instead be an onshore system in other embodiments.

As will be appreciated, the drilling rig 14 can include surface equipment positioned over the water, such as pumps, power supplies, cable and hose reels, control units, a diverter, a gimbal, a spider, and the like. Similarly, the riser 16 may also include a variety of components, such as riser joints, flex joints, a telescoping joint, fill valves, and control units, to name but a few. The wellhead assembly 18 can include equipment coupled to a wellhead 20, such as to enable the control of fluid from the well 12. The wellhead 20 can also include various components, such as casing heads, tubing heads, spools, and hangers.

Figure 2:
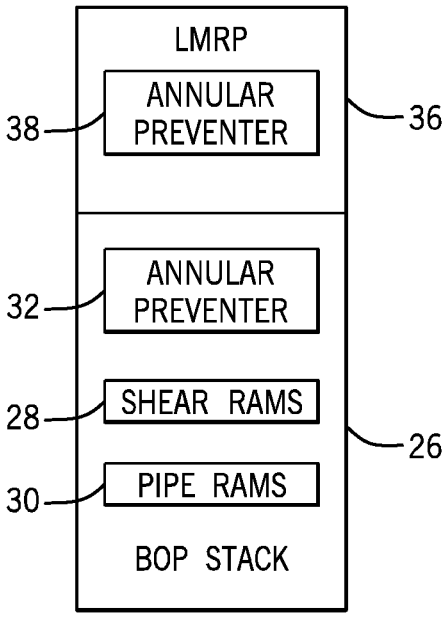
FIG. 2 is a block diagram depicting a blowout preventer stack assembly of the apparatus of FIG. 1 in accordance with one embodiment.

Any suitable blowout preventers, such as ram-type preventers or annular preventers, could be used at one or more locations in the apparatus 10. For instance, blowout preventers can be located at the surface on the drilling rig 14 or provided as part of the wellhead assembly 18 at the submerged wellhead 20. One example of a blowout preventer stack 26 that may be used in the apparatus 10 is generally depicted in FIG. 2. The blowout preventer stack 26 includes ram-type preventers (represented as shear rams 28 and pipe rams 30) and an annular preventer 32. The number of ram-type preventers used in the blowout preventer stack 26, as well as their configurations (e.g., ram type, size, and capabilities), can vary between different implementations, as can the number and configurations of annular preventers. In one subsea embodiment, a lower marine riser package (LMRP) 36 having an annular preventer 38 is attached to the blowout preventer stack 26. It will be appreciated that the lower blowout preventer stack 26 and the LMRP 36 can include other components in addition to or in place of those depicted in FIG. 2. The LMRP 36, for example, can include control pods for controlling operation of the preventers of the lower blowout preventer stack 26 and the LMRP 36. In some other embodiments, such as surface embodiments, the LMRP 36 is omitted.

Figure 3:
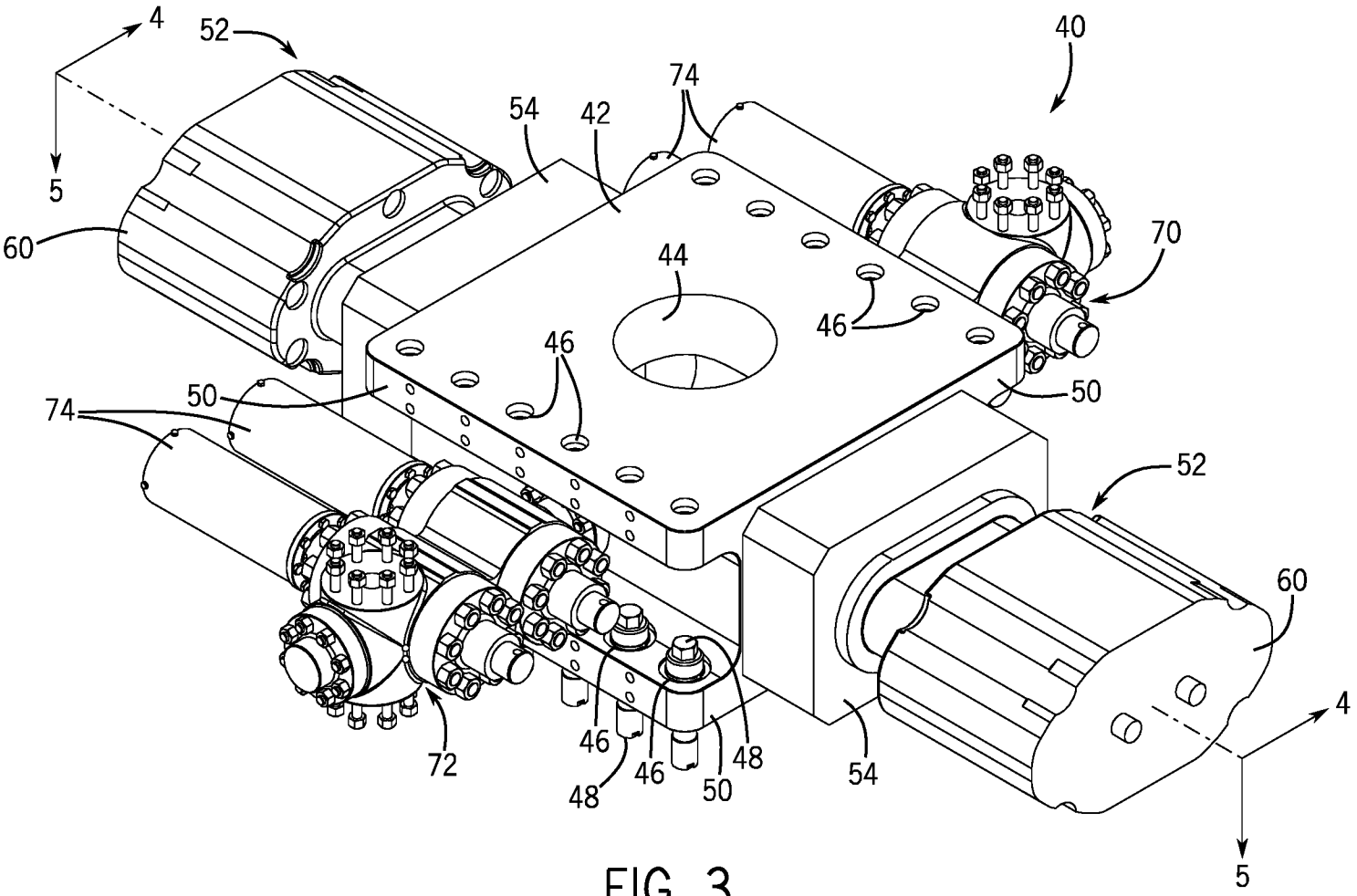
FIG. 3 is a perspective view of a blowout preventer having a main body with external connection flanges protruding laterally from sides of a ram cavity body portion in accordance with one embodiment.
Figure 4:
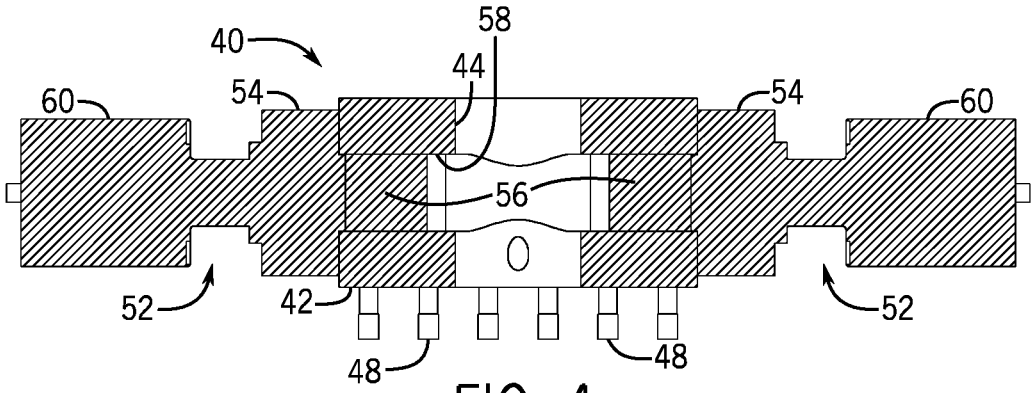
FIGS. 4 and 5 are cross-sections of the blowout preventer of FIG. 3 and show certain internal components in accordance with one embodiment.
Figure 5:
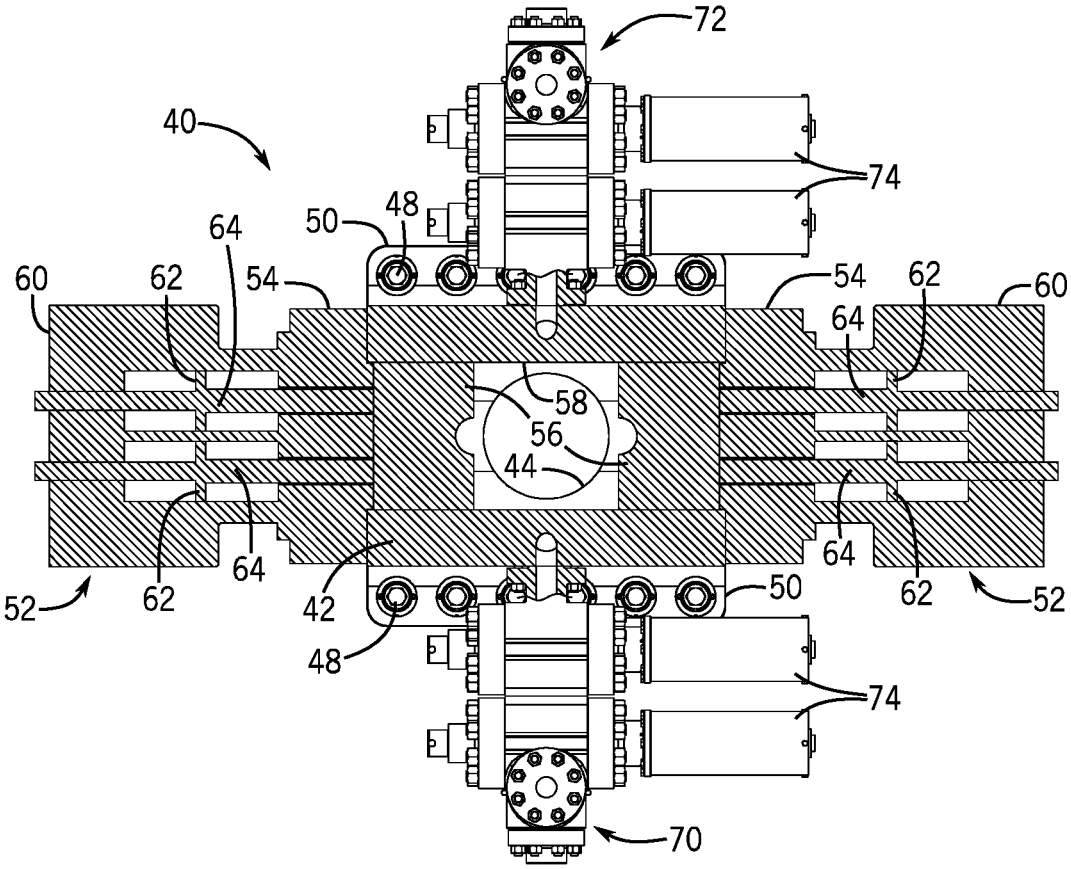

A ram-type blowout preventer 40 is illustrated in FIGS. 3-5 as an example of a blowout preventer that can be included in a blowout preventer stack 26. The blowout preventer 40 includes a hollow main body 42 and a main bore 44 (which may also be referred to as a drill-through bore) that enables passage of fluid or tubular members through the blowout preventer 40. As will be appreciated, the blowout preventer 40 may be coupled to additional blowout preventers of a blowout preventer stack 26 or to other equipment, such as via holes 46 that receive fasteners 48. Although depicted in the form of bolts and nuts in FIG. 3, the fasteners 48 could take any other suitable form in different embodiments.

Many other blowout preventers include tubular connection necks that extend outwardly from central portions of their main bodies along their main bores. These connection necks lengthen the main bores and increase the height of such blowout preventers. That is, the extensions of the main bores by the connection necks provide additional axial space between central bodies of the preventers for fasteners (e.g., of a bolted or studded connection) to be used. These connection necks typically include flanges that conform to American Petroleum Institute (API) Specification 6A (i.e., the flanges are API flanges), and the flanged connection necks can be referred to as vertical bore API connections. Such an API connection allows fastening of a blowout preventer to another component along the neck (at the flange) and near the main bore over or under a central portion of its body—in the case of a ram-type preventer, over or under a ram cavity portion of the body, for instance.

In contrast, the blowout preventer 40 does not have a flanged connection neck that extends the main bore 44 and facilitates connection to another component. Rather, the depicted blowout preventer 40 includes a wide-flange body profile having external connection flanges 50 that protrude laterally at sides of the main body 42. This allows the blowout preventer 40 to be connected to other blowout preventers or components with fasteners 48 positioned alongside the main body 42 rather than at necks above and below the main body 42. As shown in FIGS. 3 and 5, the connection flanges 50 include a bolt pattern with parallel rows of holes 46 through which fasteners 48 may be installed.

Bonnet assemblies 52 of the blowout preventer 40 include bonnets 54 secured to the main body 42. The bonnet assemblies 52 include cylinders that house various components that facilitate control of rams 56 disposed in a ram cavity 58 of the blowout preventer 40. In the presently depicted embodiment, the rams 56 operate in response to hydraulic pressure from control fluid routed into the bonnet assemblies 52. More particularly, as illustrated in the cross-sections of FIGS. 4 and 5, the blowout preventer 40 includes rams 56 controlled by actuation assemblies 60 having operating pistons 62 and connecting rods 64. The blowout preventer 40 is here depicted as a single-ram blowout preventer having one pair of rams 56. The rams 56 in FIGS. 4 and 5 are generally depicted as pipe rams, which can include sealing elements (also known as ram packers) that cooperate with one another when driven together to seal about a pipe or other tubular member and inhibit flow through the bore 44 of the blowout preventer 40. The rams 56 could take other forms, however, such as blind rams or shear rams. Further, in other embodiments the blowout preventer 40 may have a different number of rams. For example, the blowout preventer 40 could instead be a double-ram blowout preventer with two ram cavities and two pairs of rams or a triple-ram blowout preventer with three ram cavities and three pairs of rams. The number of rams, along with their types and sizes, may be selected based on the intended application.

In operation, a force (e.g., from hydraulic pressure provided by control fluid) may be applied to the operating pistons 62 to drive the rams 56, via the connecting rods 64, into the bore 44 of the blowout preventer 40. The connecting rods 64 extend through the bonnets 54 and enable forces on the pistons 62 to be transmitted to the rams 56. Only certain portions of the bonnet assemblies 52 have been generally depicted in FIGS. 3-5 for explanatory purposes, and the skilled artisan will appreciate that the bonnet assemblies 52 may have other components. For instance, various seals may be provided between the connecting rods 64 and the bonnets 54 to inhibit leaking while enabling axial movement of the connecting rods through the bonnets. Although the rams 56 are illustrated as hydraulically actuated rams in the presently depicted embodiment, it is noted that the rams 56 could be actuated in any other suitable manner as well.

In the embodiment shown in FIG. 5, each ram 56 is controlled by an actuation assembly 60 having two pistons 62. Because hydraulic force on the operating pistons 62 is proportional to the surface areas to which pressure is applied, the two pistons 62 per ram 56 allow the pistons 62 to cumulatively provide the same reactive surface area as a single, larger piston 62. This, in turn, enables a compact design with bonnet assemblies 52 occupying less vertical space along the blowout preventer 40. But in other embodiments each ram 56 may be controlled with a different number of pistons 62, such as with a single piston.

The blowout preventer 40 is depicted in FIGS. 3 and 5 as having choke and kill line connection assemblies 70 and 72 mounted to the exterior of the main body 42. Choke and kill lines can be connected to the assemblies 70 and 72 in fluid communication with the bore 44 to allow drilling fluid to enter into the bore 44 and to circulate fluid between choke and kill lines to control wellbore pressure. The assemblies 70 and 72 include valves 74 for controlling flow between the choke and kill lines and the bore 44.

Figure 6:
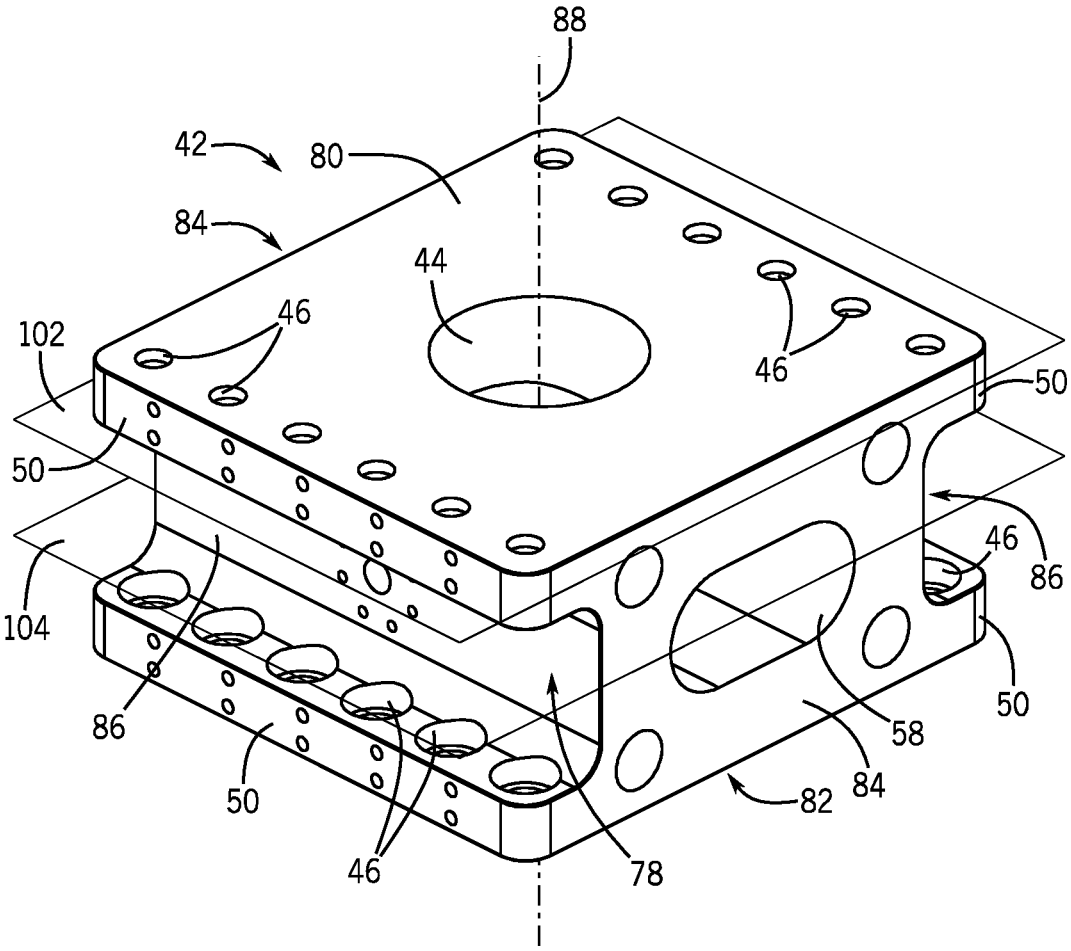
FIG. 6 is a perspective view of the body of the blowout preventer of FIG. 3.
Figure 7:
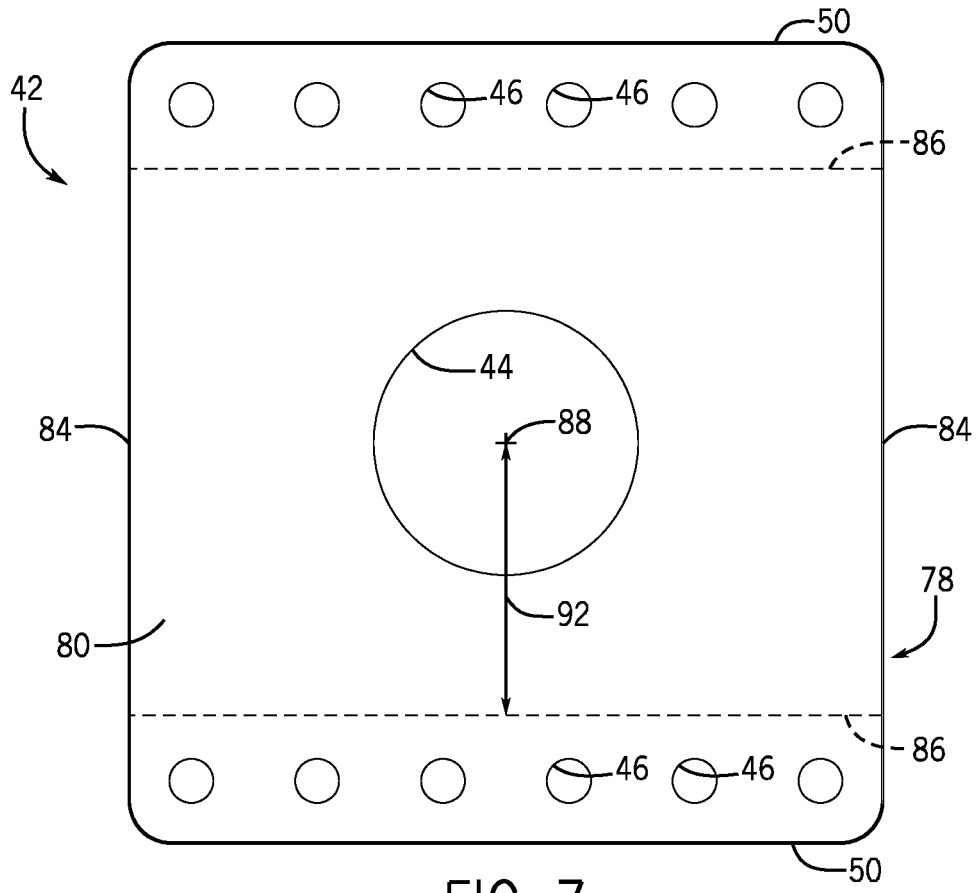
FIG. 7 is a top plan view of the body of the blowout preventer of FIG. 3.
Figure 8:
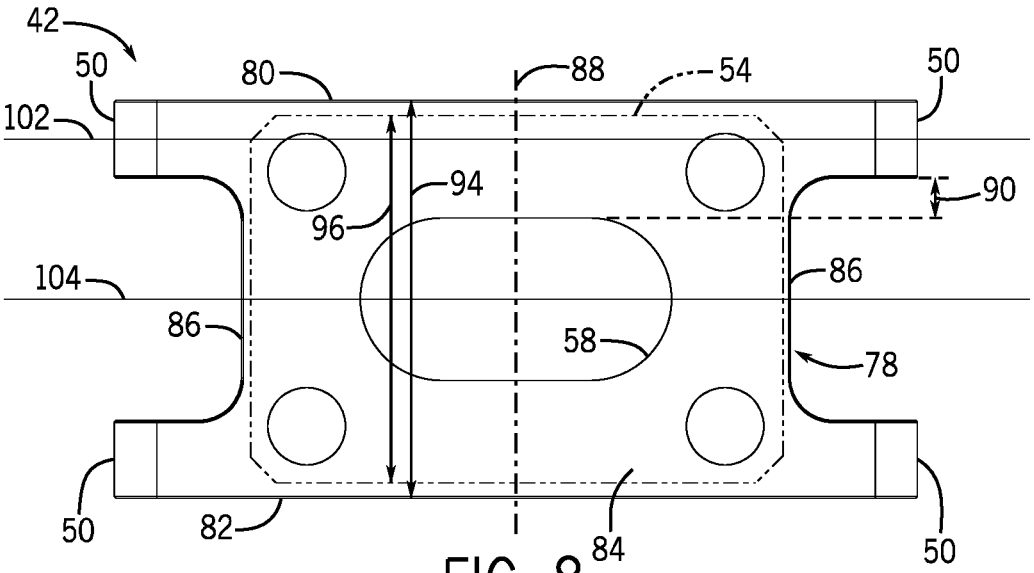
FIG. 8 is an elevational view of the body of the blowout preventer of FIG. 3.

Additional features of the main body 42 of the blowout preventer 40 may be better appreciated with reference to FIGS. 6-8. As shown in these figures, the main body 42 includes a ram cavity body portion 78, which defines the ram cavity 58, and external connection flanges 50 protruding laterally from the ram cavity body portion 78. The bore 44 extends vertically through the body 42 (more particularly, through the ram cavity body portion 78) from an upper surface 80 to a lower surface 82. The ram cavity 58 extends laterally through the ram cavity body portion 78 between opposing ends 84 and is transverse to the bore 44, allowing the rams 56 to be extended into the bore 44 during well control operations. The bonnet assemblies 52 may be connected to the opposing ends 84, as shown in FIGS. 3 and 5.

The ram cavity body portion 78 also includes opposing sides 86 that run the length of the body 42 between the opposing ends 84. The connection flanges 50 protrude from these opposing sides 86 and allow the blowout preventer 40 to be fastened to other components (such as additional blowout preventers) along the sides of the ram cavity body portion 78, rather than above and below the ram cavity body portion 78 (as would be the case with vertical bore API connections). In the presently depicted embodiment, the body 42 includes an upper pair of connection flanges 50 extending laterally from the top of the ram cavity body portion 78 and a lower pair of connection flanges 50 extending laterally from the bottom of the ram cavity body portion 78, with the upper and lower surfaces 80 and 82 being rectangular planar surfaces (which may include rounded corners, such as shown in FIG. 7) that include sides of the flanges 50. In other instances, the flanges 50 could be axially offset (with respect to a central axis 88 of the bore 44) from the top and bottom surfaces of the body 42. In at least some embodiments, including that depicted in FIGS. 6-8, the body 42 is constructed such that the shortest axial distance between a connection flange 50 and the ram cavity 58 (the distance measured parallel to the central axis 88 and generally represented by arrow 90 in FIG. 8) is less than the shortest radial distance between the connection flange 50 and the central axis 88 (as generally represented by arrow 92 in FIG. 7).

Omitting vertical bore API connections from the upper and lower surfaces 80 and 82 allows a reduction in the height of the body 42 (generally represented by arrow 94 in FIG. 8). In some cases, the height of the body 42 is reduced to an amount similar to the height of bonnets 54 (generally represented by arrow 96 in FIG. 8) connected to the opposing ends 84. For example, the body 42 and an attached bonnet 54 can be configured such that the height of the bonnet 54 is more than ninety or ninety-five percent of that of the body 42. This allows closer axial spacing of bonnets 54 in blowout preventer stacks having multiple blowout preventers 40 (compared to a stack of blowout preventers with vertical bore API connections and connected bonnets axially spaced further apart due to the increased height associated with the vertical bore API connections) and may facilitate reductions of both height and weight in such blowout preventer stacks.

Figure 9:
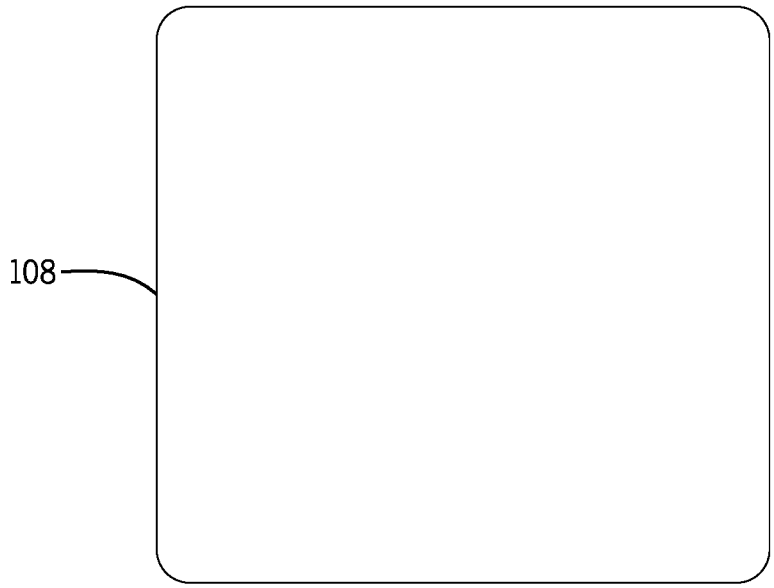
FIGS. 9 and 10 depict outer perimeters of the blowout preventer body of FIGS. 6-8 lying within reference planes depicted in FIGS. 6 and 8.
Figure 10:
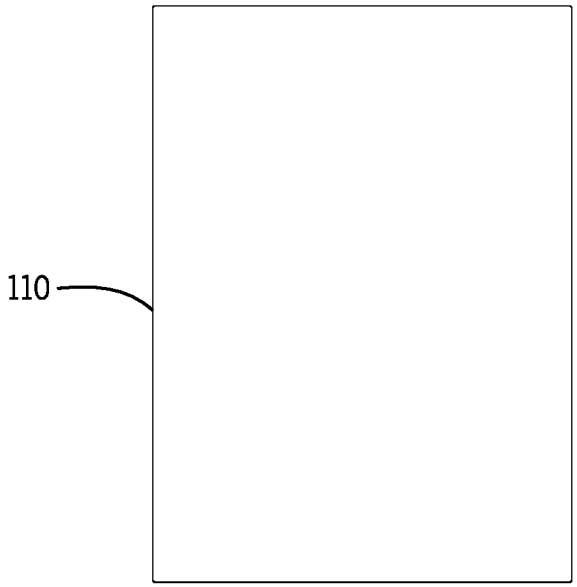

Though some other embodiments may differ, in at least some embodiments the blowout preventer body 42 is widest measured across the external connection flanges 50. Moreover, in the embodiment depicted in FIGS. 6-8 the outer perimeter of the body 42 about its lateral edges is larger at the portions of the body 42 including the flanges 50. By way of example, FIGS. 6 and 8 show parallel planes 102 and 104 extending through the body 42 perpendicular to the bore 44. The plane 102 extends through the upper connection flanges 50, while the plane 104 extends through the ram cavity 58 without passing through any of the connection flanges 50. The two-dimensional profiles of the body 42 lying in the planes 102 and 104 are depicted in FIGS. 9 and 10, with an outer perimeter 108 of the body 42 within the plane 102 shown in FIG. 9 and an outer perimeter 110 of the body 42 within the plane 104 shown in FIG. 10. As can be seen from these figures, the cross-sectional area bounded by the perimeter 108 is larger than that bounded by the perimeter 110.

Figure 11:
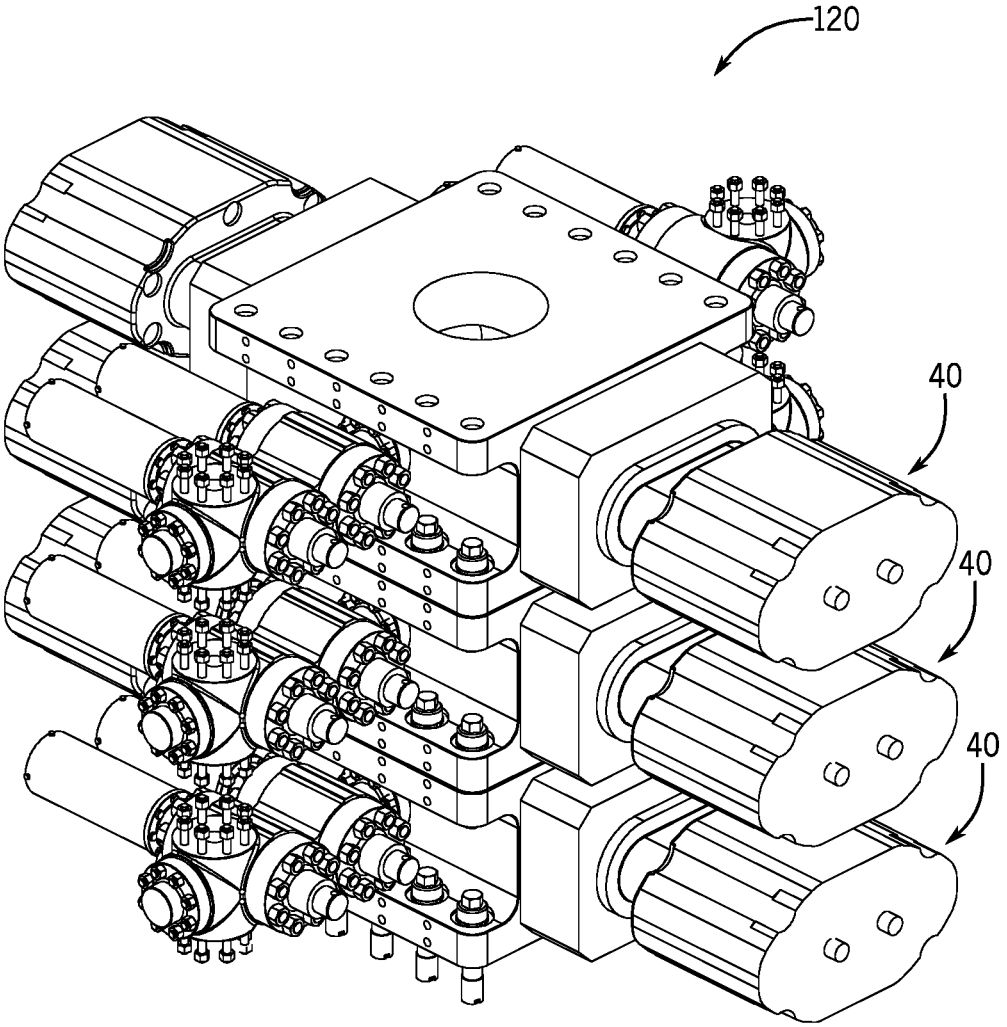
FIGS. 11 and 12 depict modular blowout preventer stacks having multiple blowout preventers with identical main bodies in accordance with certain embodiments.
Figure 12:
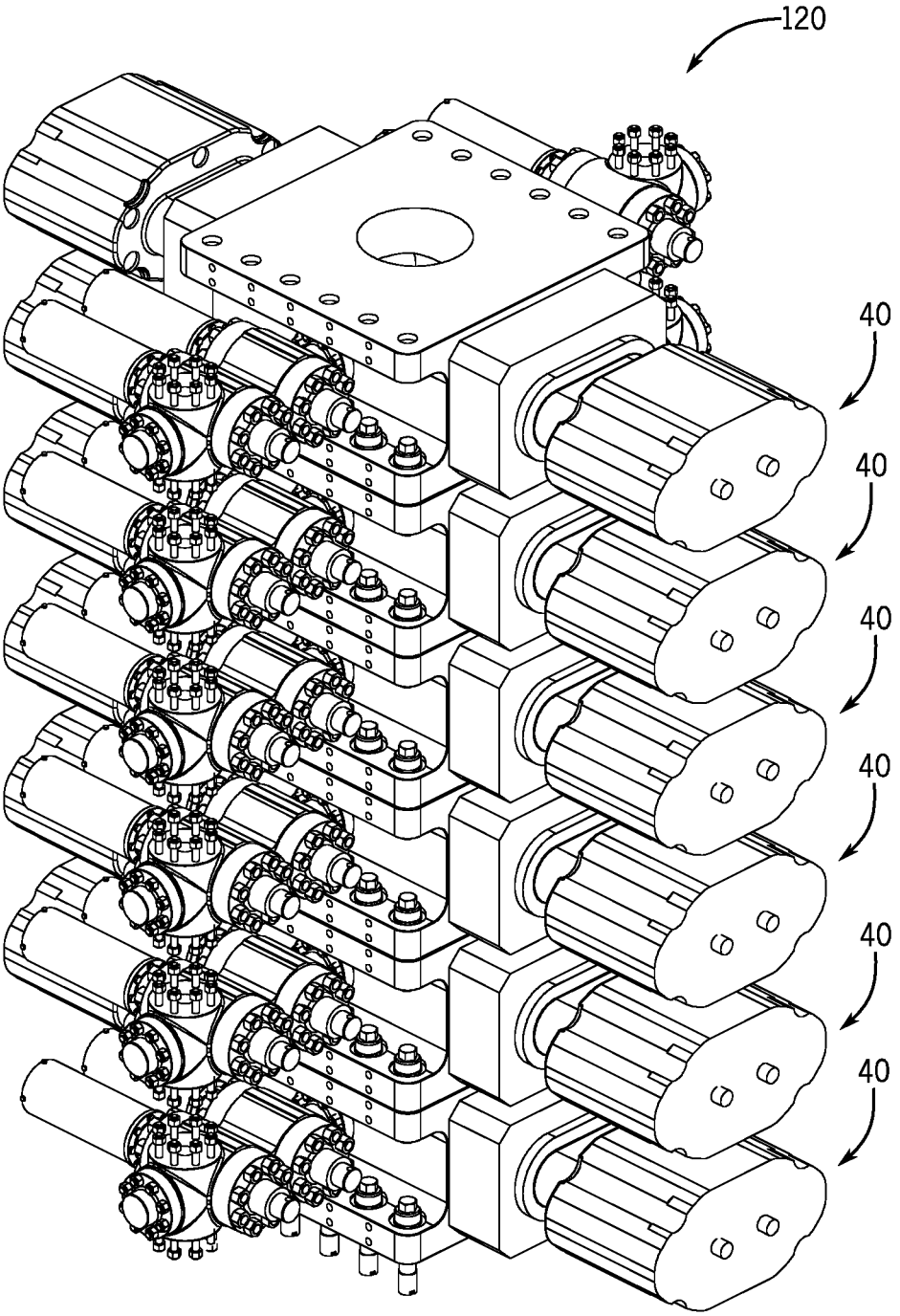

The blowout preventer 40 can be installed with other blowout preventers in a blowout preventer stack, as discussed above. In at least some embodiments, multiple blowout preventers 40 with structurally identical bodies 42 (each having the same bore, ram cavity, and size) can be used to construct a modular blowout preventer stack. Two examples of such modular blowout preventer stacks 120 are depicted in FIGS. 11 and 12 as having three blowout preventers 40 and six blowout preventers 40, respectively, although other numbers of preventers 40 could be used in additional embodiments. The blowout preventers 40 in the blowout preventer stacks 120 of FIGS. 11 and 12 have independent and separable main bodies 42, as in FIGS. 3-8, and each of the preventers 40 is fastened directly to adjoining preventers 40 in the stack 120 via the external connection flanges 50. This is in contrast to other blowout preventer stacks using vertical bore API connections located axially between ram cavity body portions of the preventers or using tie rods to hold the preventers of a stack together without being fastened directly to one another. Although not presently depicted, it will be appreciated that the upper and lower surfaces 80 and 82 of the blowout preventer bodies 42 can include seal grooves about the ends of their bores 44. Any suitable seal ring or gasket can be provided in these seal grooves to inhibit leakage from the bores 44 between the blowout preventer bodies 42 in the blowout preventer stacks 120. In at least some embodiments, the blowout preventers 40 are pre-assembled, with bonnet assemblies 52 attached to the bodies 42, prior to integration of the blowout preventers 40 in a blowout preventer stack 120.

By omitting vertical bore API connections and flanged necks between the blowout preventers 40, the heights of the blowout preventer stacks 120 may be substantially reduced. For example, in one embodiment the blowout preventer body 42 of each preventer 40 may be designed for service with an eighteen-and-three-quarter-inch (approx. 48-cm) bore at a rated pressure of 15 ksi (approx. 103 MPa), and the omission of vertical bore API connections allows the height of each preventer to be reduced by approximately sixteen inches (approx. 41 cm). This height savings, and accompanying weight savings, facilitates the assembly of lighter and shorter blowout preventer stacks. And in at least some embodiments, this makes the blowout preventer stacks easier to handle on drilling rigs, reduces space requirements on the drilling rigs for storing the blowout preventer stacks, and reduces the loads and bending moments on wellheads when installed.

Further, although the body sizes of the blowout preventers 40 could vary in some other implementations, the ram-type preventers in the blowout preventer stacks 120 of FIGS. 11 and 12 use a blowout preventer body 42 with a standardized design common to each ram-type preventer. Even with a standardized body 42, different rams or bonnet assemblies could be used with the blowout preventers 40 of a given blowout preventer stack. Using a single, standardized body 42 with one size and one configuration (per bore size and per pressure rating) with one ram cavity for each preventer 40 may also allow operators to maintain a more efficient capital spares program by having to stock just one body configuration for a given bore size and pressure rating, rather than stocking different bodies with different numbers of ram cavities and configurations, such as singles (with one ram cavity), doubles (with two ram cavities), extended doubles, triples (with three ram cavities), and extended triples. Instead, the number of ram cavities that would be present in a double- or triple-cavity preventer can be provided by a combination of two or three of the single preventer bodies 42. As discussed in additional detail below with respect to FIG. 18, one or more spacers can be positioned between single preventer bodies 42 to provide axial space for bonnet assemblies taller than a single body 42 to be used.

As described above, the blowout preventer 40 can include choke and kill line connection assemblies 70 and 72 mounted on the exterior of the blowout preventer body 42. A blowout preventer stack 120 including one or more of such blowout preventers 40, such as the blowout preventer stacks 120 depicted in FIGS. 11 and 12, can have choke and kill lines that run along the outside of the stack 120 and are connected to the blowout preventers 40 via the external choke and kill line connection assemblies 70 and 72. In at least some embodiments, however, a blowout preventer 40 instead includes internal choke and kill line pass-through conduits arranged to be aligned with similar internal conduits of other blowout preventers 40. Multiple blowout preventers 40 having such internal choke and kill line conduits can be assembled in a blowout preventer stack so as to form a shared, internal choke line conduit and a shared, internal kill line conduit running through the blowout preventer bodies.

Figure 13:
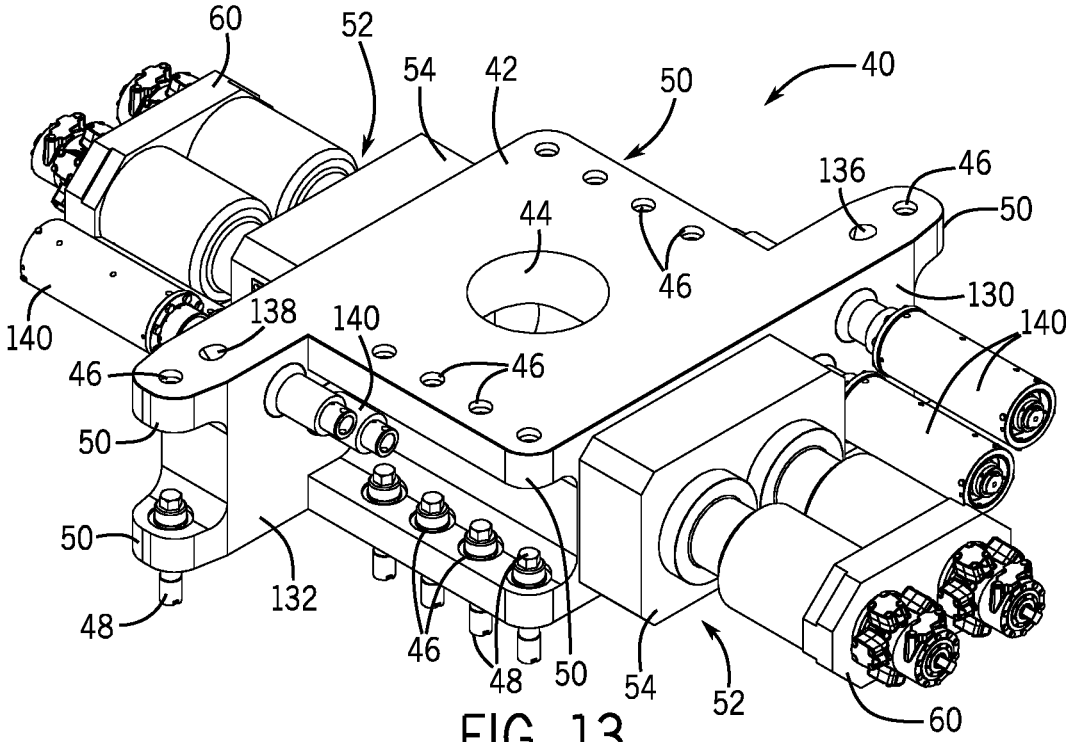
FIG. 13 is a perspective view of a blowout preventer having choke and kill line conduits, with associated valves, integrated into its main body in accordance with one embodiment.
Figure 14:
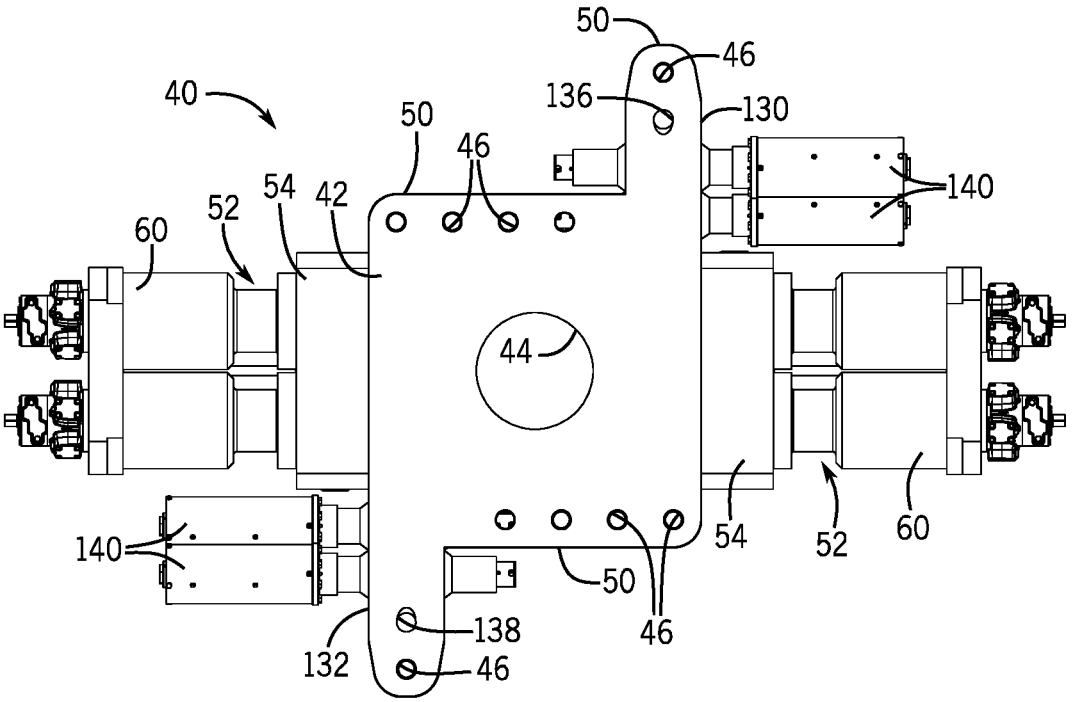
FIG. 14 is a top plan view of the blowout preventer of FIG. 13.
Figure 15:
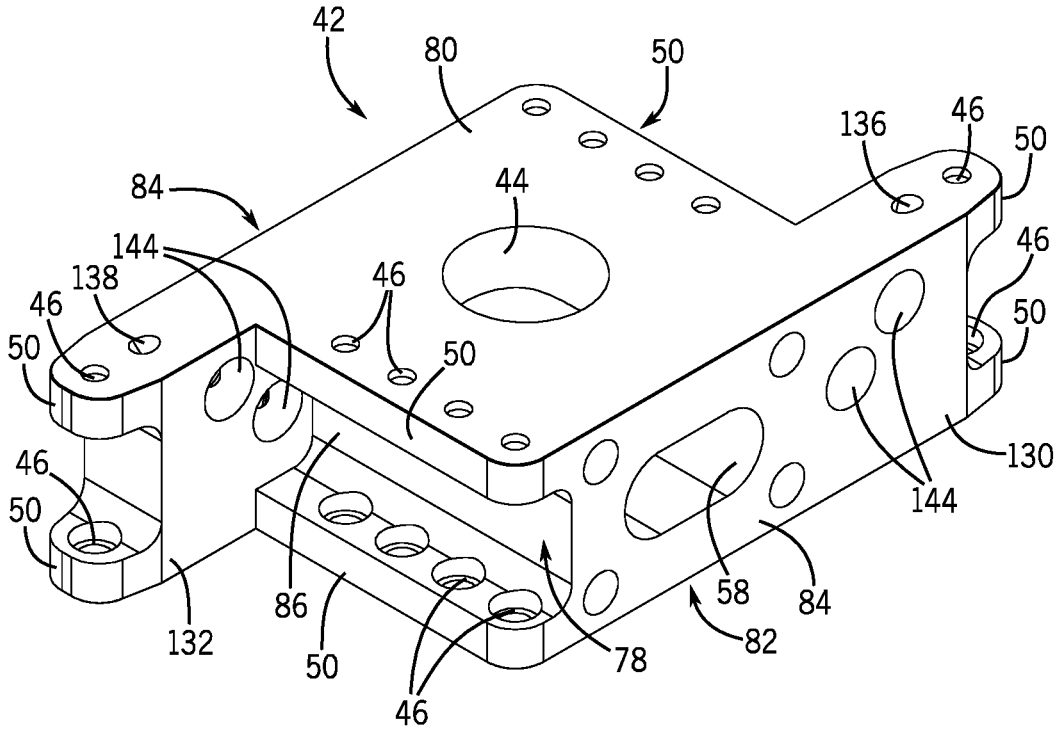
FIG. 15 is a perspective view of the main body of the blowout preventer of FIG. 13.
Figure 16:
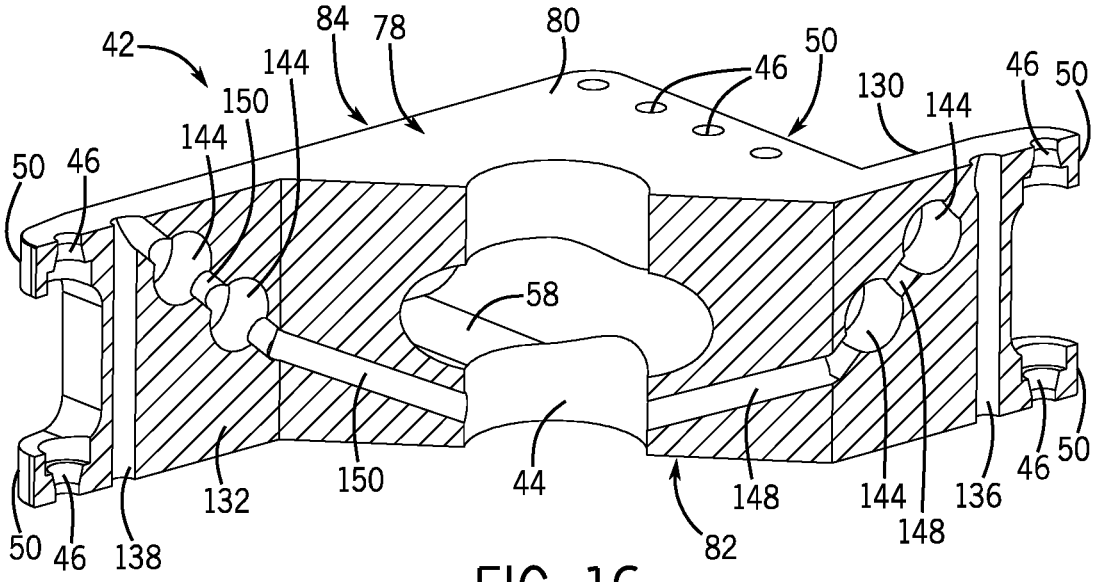
FIG. 16 is a section view of the main body depicted in FIG. 15, showing the internal choke and kill line conduits with access branches connecting to a main bore, in accordance with one embodiment.

By way of example, a blowout preventer 40 with such internal choke and kill line conduits is illustrated in FIGS. 13 and 14, with the main body 42 of this preventer 40 depicted in FIGS. 15 and 16. In this depicted embodiment, the blowout preventer 40 is similar to that shown in FIG. 3, but its body 42 includes protrusions 130 and 132 extending laterally from opposing sides 86 of the ram cavity body portion 78. Pass-through conduits 136 and 138 extend vertically through the protrusions 130 and 132 parallel to the bore 44, while valves 140 (such as gate valves) are provided to control flow through access branch conduits between the bore 44 and the conduits 136 and 138. In at least some embodiments, including that shown in FIGS. 13-16, the lateral protrusions 130 and 132 are identical to one another and each of the conduits 136 and 138 could serve as a choke line conduit or a kill line conduit. For ease of explanation, however, the conduit 136 will be referred to as the choke line conduit 136 and the conduit 138 will be referred to as the kill line conduit 138 below.

The protrusions 130 and 132 of the blowout preventer body 42 include valve preparation recesses 144 for receiving the valves 140. These valve preparation recesses 144 are transverse to choke and kill line access branch conduits 148 and 150 that extend through the body 42 to connect the choke line conduit 136 and the kill line conduit 138 to the bore 44. When installed in these recesses 144, the valves 140 control flow between the bore 44 and the choke and kill line conduits 136 and 138 through the access branches 148 and 150. The lateral protrusions 130 and 132 are also depicted in FIGS. 13-16 as including external connection flanges 50 that allow the protrusions of adjacent preventers 40 in a blowout preventer stack to be fastened to one another in a manner similar to that described above with respect to the connection flanges 50 along the ram cavity body portions 78.

Figure 17:
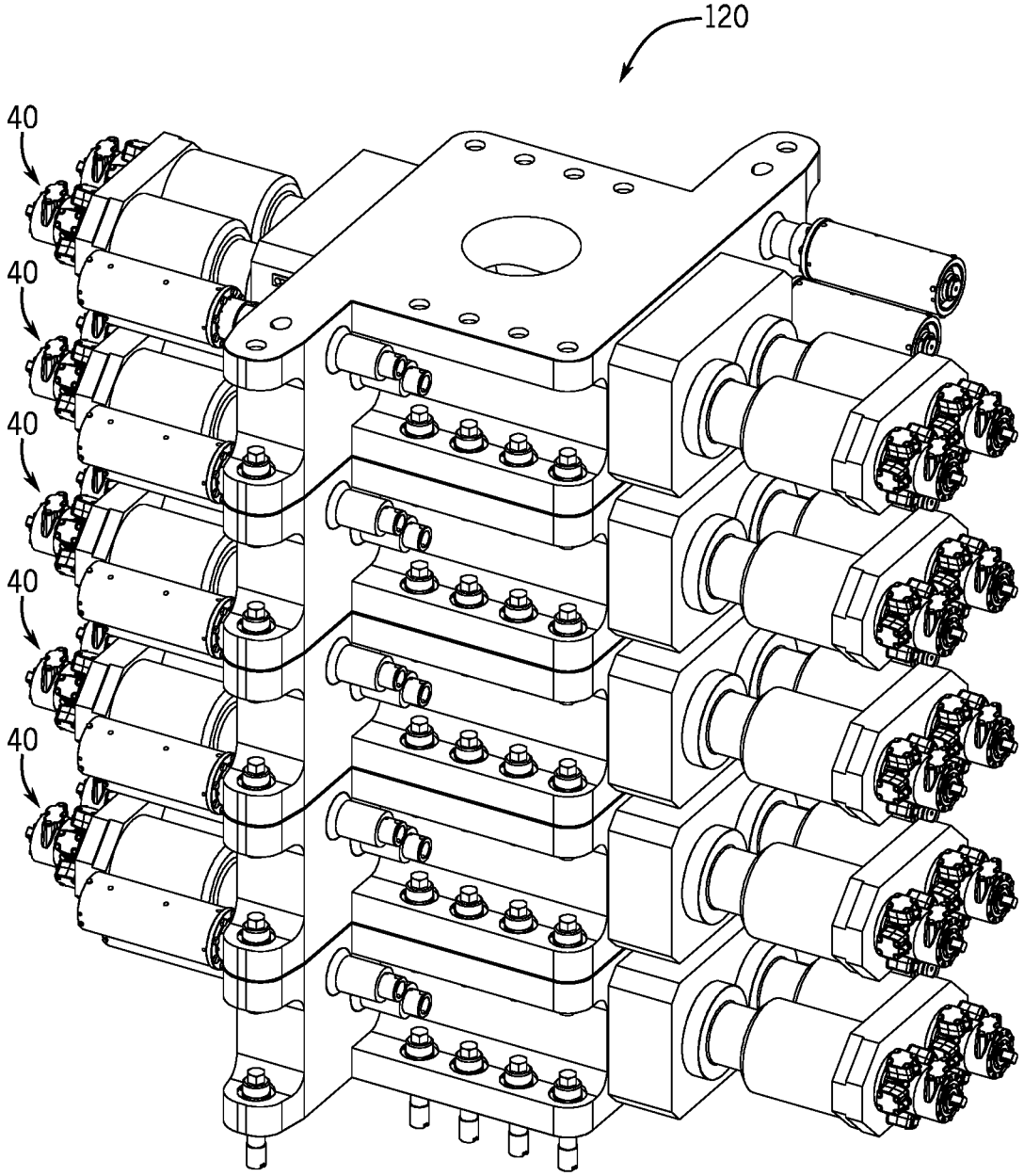
FIG. 17 depicts a modular blowout preventer stack having multiple blowout preventers with identical main bodies and internal choke and kill lines integrated into the bodies of the blowout preventers in accordance with one embodiment.
Figure 18:
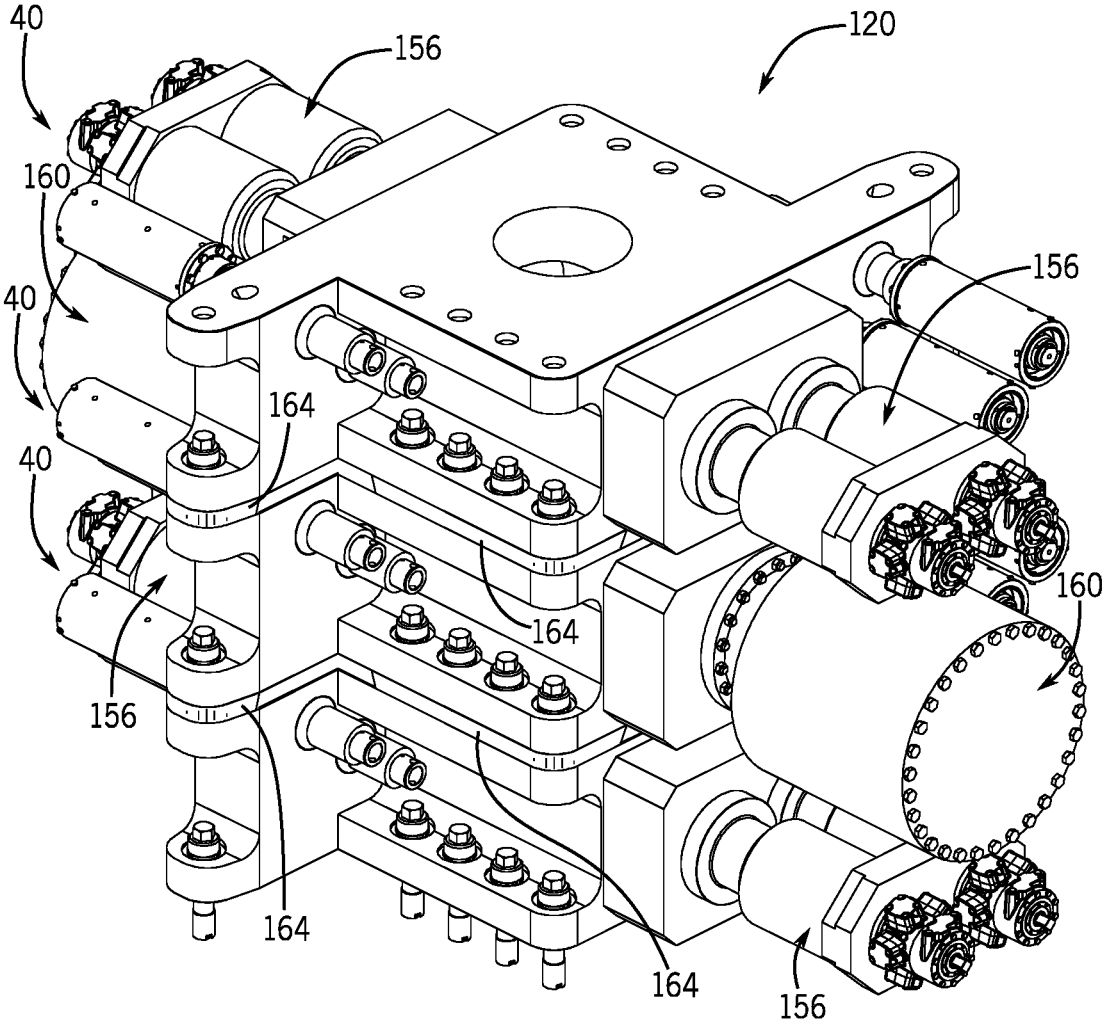
FIG. 18 shows a modular blowout preventer stack having multiple blowout preventers with axial spacers for accommodating the use of larger bonnet assemblies in the blowout preventer stack in accordance with one embodiment.

Additional blowout preventer stacks 120 are depicted in FIGS. 17 and 18 as having multiple blowout preventers 40 with such integral choke and kill lines extending through protrusions of the blowout preventer bodies. In FIG. 17, the blowout preventer stack 120 is depicted as having five of the blowout preventers 40 in a stacked arrangement. The bodies 42 of these blowout preventers 40 are structurally identical (though the rams of the preventers may vary), and are fastened together via their external connection flanges 50. Further, the drill-through bores 44, the choke line conduits 136, and the kill line conduits 138 of the blowout preventers 40 are aligned with one another so as to form a shared drill-through bore, a shared choke line conduit, and a shared kill line conduit each extending through the five blowout preventers 40. Although not presently shown, it will be appreciated that any suitable seals could be used to prevent leakage from the shared choke and kill line conduits between adjacent preventers 40. The blowout preventers 40 can be pre-assembled, with bonnet assemblies 52 attached to the bodies 42 and valves 140 installed in the valve recesses 144, prior to integration of the blowout preventers 40 in a blowout preventer stack 120. In certain embodiments, the integration of the valves 140 into the blowout preventer bodies 42 allows conventional fabricated choke and kill spools that would be attached to the exterior of the bodies 42 to be eliminated, reducing leak paths and increasing reliability of the apparatus. This also allows the valves to be removed for servicing without disconnecting external choke and kill lines of the stack 120.

In FIG. 18, the blowout preventer stack 120 is depicted as having three blowout preventers 40. The upper and lower preventers 40 in this blowout preventer stack 120 have bonnet assemblies 156, while the middle preventer 40 includes bonnet assemblies 160. Although the bonnet assemblies 156 are shorter than the main bodies of the blowout preventers 40, the bonnet assemblies 160 have a housing that is taller. For example, the bonnet assemblies 160 may include larger pistons with greater operational areas (compared to pistons in the bonnet assemblies 156) to allow hydraulic pressure on the larger pistons to cause a greater closing force on the rams, which may be desired for certain shear applications. Spacers 164 can be positioned in the stack 120 above and below the preventer 40 to which the assemblies 160 are attached to increase the axial distance of the stack and accommodate the larger bonnet assemblies 160.

The blowout preventers 40 of FIGS. 13-18 are depicted as having external connection flanges 50 that allow the preventers to be fastened together without vertical bore API connections. In other embodiments, however, the internal choke and kill line conduits described above can be implemented in blowout preventers having such vertical bore API connections. That is, the integration of choke and kill line conduits extending through the blowout preventer bodies, and the sharing of such conduits across multiple blowout preventer bodies in a blowout preventer stack, does not depend on the elimination of vertical bore API connections.

Figure 19:
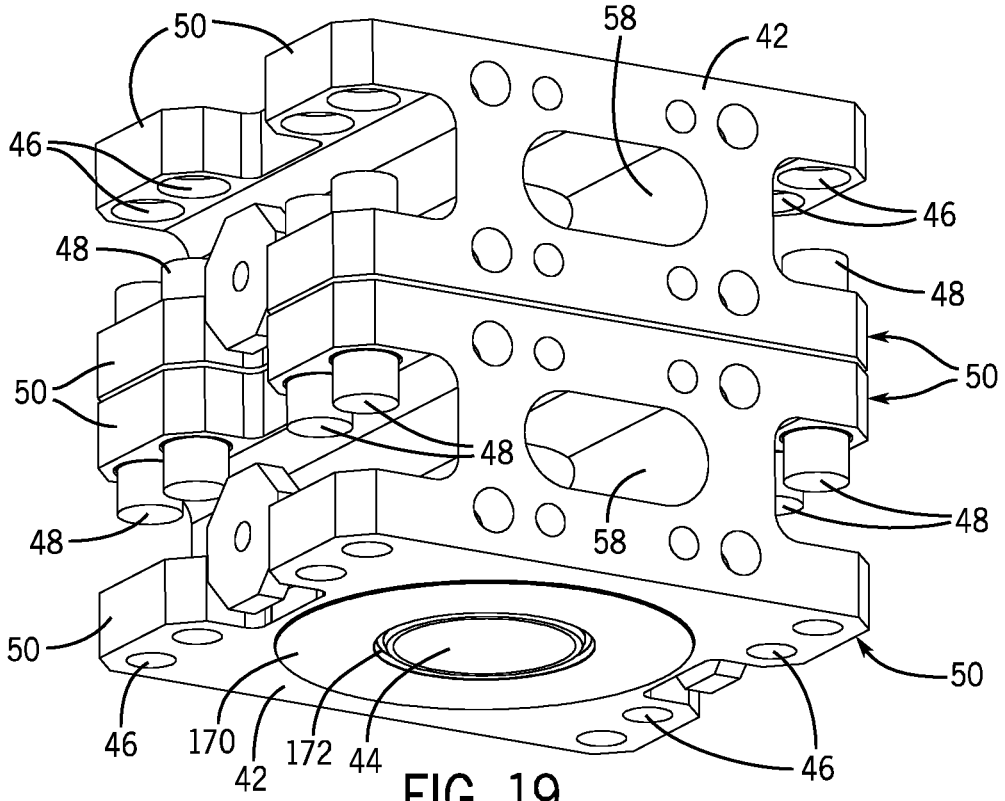
FIG. 19 is a perspective view of two blowout preventers with raised faces in a stacked configuration in accordance with one embodiment.

Upper and lower ends of blowout preventers, flex joints, connectors, and other components can be provided with raised faces to reduce the area of contact between the connected components. This reduction in the area of contact allows the bolting make-up load in a flanged connection to be concentrated over a smaller area to increase the contact pressure of mating faces, which helps the connection resist leakage due to various separating loads resulting from tensile forces and bending moments. Referring to FIG. 19, for example, blowout preventer main bodies 42 can include raised faces 170. While a raised face 170 is shown on the lower end of the bottom blowout preventer main body 42 of the stack depicted in FIG. 19, the top blowout preventer body 42 may also include a raised face 170 on its lower end. In some embodiments, the blowout preventer bodies 42 may also or instead include raised faces 170 on their upper ends. The depicted raised face 170 includes a seal groove 172 for receiving a seal ring or gasket.

As shown in FIG. 19, the raised face 170 extends continuously from the bore 44 to the outer edge of the raised face 170, with the lone exception of the single seal groove 172. In at least some embodiments, however, the raised face includes at least one additional recess in the raised face 170. This additional recess further increases the contact pressure on the raised face 170 for a given bolting make-up load applied via the flanged connection.

Figure 20:
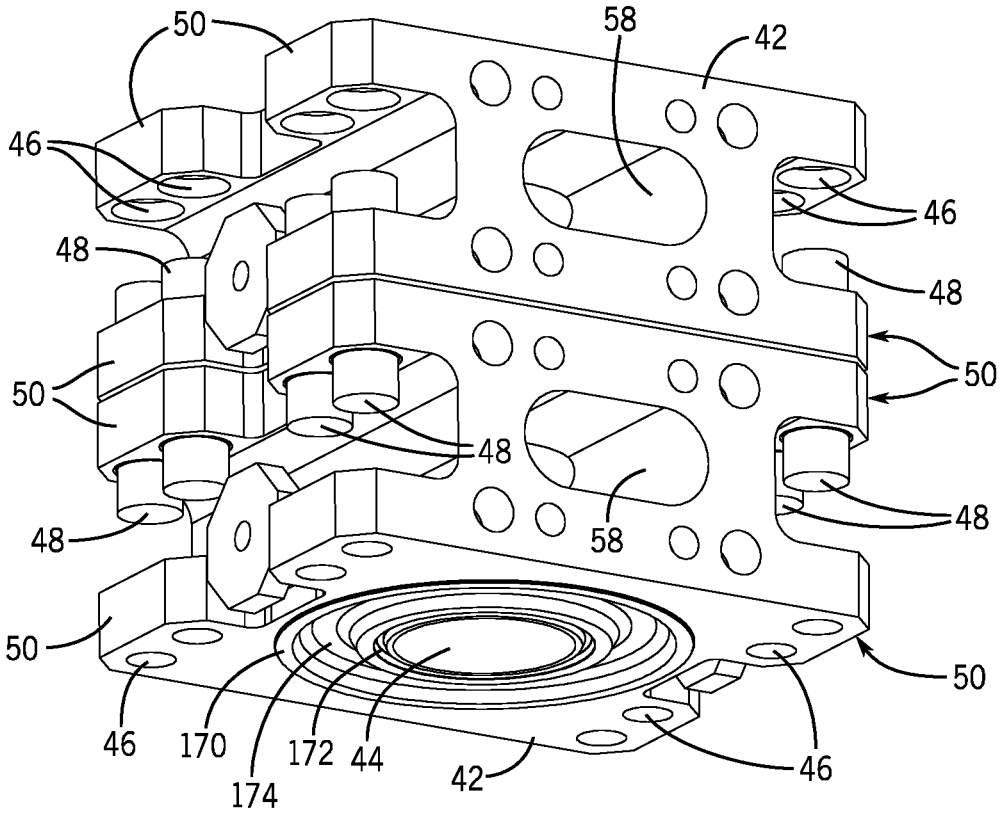
FIG. 20 is a perspective view of two blowout preventers like those of FIG. 19, but in which the raised faces having partitioning grooves in accordance with one embodiment.
Figure 21:
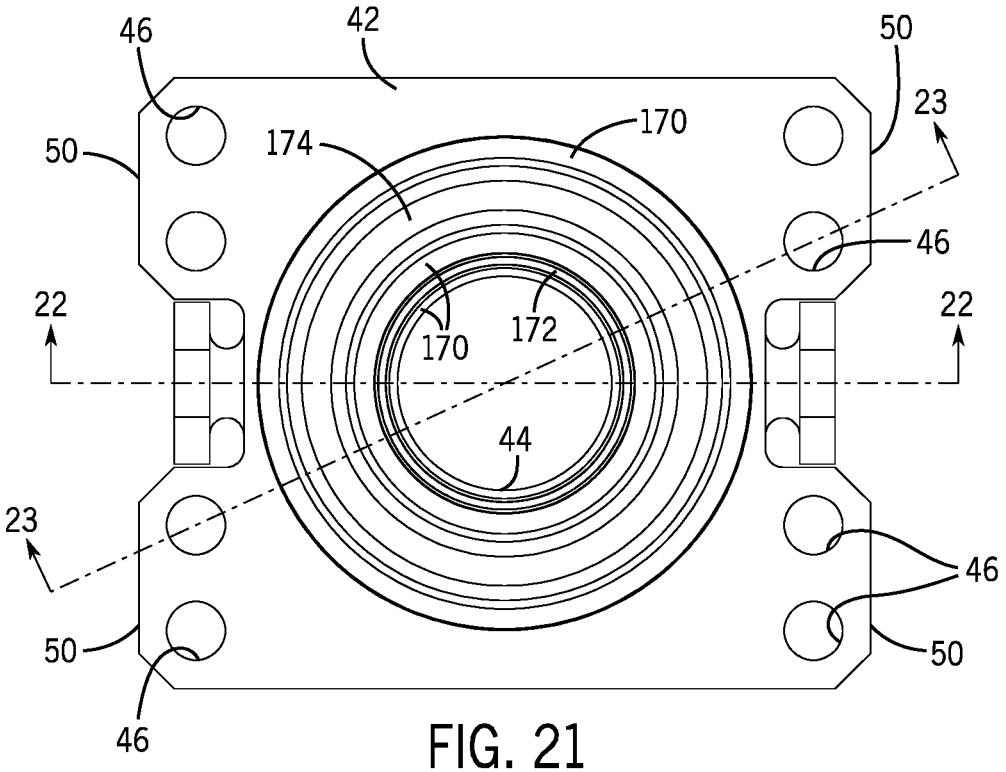
FIG. 21 is a top plan view of the blowout preventer stack of FIG. 20.

One example of such an additional recess is shown in FIGS. 20 and 21 as a recess 174 provided in the raised face 170 outward of the seal groove 172. In these two figures, the recess 174 is shown as a circular groove that is concentric with the circular seal groove 172 and with the circular outer perimeter of the raised face 170, and that partitions the raised face 170 into inner and outer contact surfaces. But the seal groove 172, the recess 174, and the outer perimeter of the raised face 170 may be provided in other shapes in different embodiments, and need not be the same shape. For instance, the raised face 170 could have an oval, rectangular, or irregular outer perimeter. Similarly, the recess 174 could be provided as an oval, rectangular, or irregular groove. In other instances, the raised face 170 may include multiple recesses 174, which may themselves be concentric grooves or have some other shape. Further, the one or more recesses 174 could be provided as non-continuous grooves (e.g., semi-circular slots or radial slots) or other indentations (e.g., pockets) in the raised face 170. In certain embodiments in which the recess 174 is provided as a groove that partitions the raised face 170 into inner and outer contact surfaces, the inner and outer contact surfaces may be stepped such that the inner contact surface protrudes further from the main body 42 than does the outer contact surface.

Figure 22:
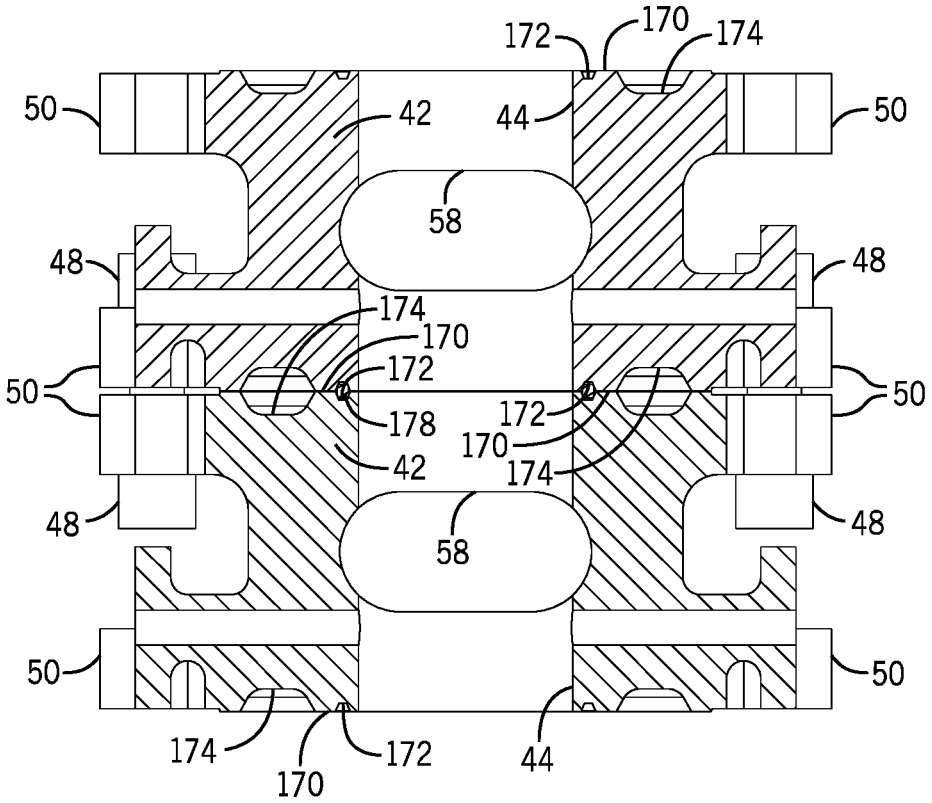
FIGS. 22 and 23 are cross-sections of the blowout preventer stack of FIG. 20.

In FIG. 22, each of the main bodies 42 is shown as having upper and lower raised faces 170, and the main bodies 42 are coupled together via flanges 50 such that adjoining raised faces 170 of the two main bodies 42 (i.e., at the bottom of the upper main body 42 and the top of the lower main body 42) are in contact. A seal ring 178 is positioned in the seal grooves 172 of the adjoining raised faces 170 to inhibit leakage between the main bodies 42 from the bore 44. As may be seen in FIG. 22, the recesses 174 in the raised faces 170 reduce the area of contact between the adjoining raised faces 170 of the two main bodies 42.

Each recess 174 can have any desired width and depth. In certain embodiments, for example, the width of the recess 174 (measured along the contact surface of the raised face 170) is at least two, three, or four times that of the seal groove 172. Likewise, the depth of the recess 174 is at least two, three, or four times that of the seal groove 172 in at least some embodiments. The width of the recess 174 (again, measured along the contact surface) can also be compared to the width of the raised face 170 between the bore 44 and the outer perimeter of the raised face 170. The width of the recess 174 could be more than one-third or more than one-half of the radial distance from the bore 44 to the outer perimeter of the raised face 170, for example. The recess 174 can also have various contours. In some embodiments, the recess 174 is provided as a groove with a semi-hexagonal shape (like the shape of the seal groove 172), a semi-oval shape, a rectangular shape, or a triangular shape, though the recess 174 could have still other shapes (including irregular shapes) in different embodiments.

Recesses 174 can be formed by removing material from lower-stress areas at the ends of the main bodies 42, which also reduces the weight of the main bodies 42. Additionally, the recesses 174 increase connection efficiency by causing increased contact pressure of the mating raised faces 170 for a given bolting make-up load in a flanged connection. This facilitates using the same bolts for greater loads (increased capacity) or smaller bolts to provide the original make-up load. Still further, the recesses 174 facilitate extension of the outer perimeter of the raised faces 170 closer to the outer edge of the flanges, which may decrease stress levels in the ends of the main bodies 42 and in the bolting from make-up loads. Although the raised faces 170 with recesses 174 are shown and discussed above with respect to FIGS. 20-22 as part of wide-flanged ram-type blowout preventers, the same techniques can be applied to other wide-flanged components or to other components with traditional flanged connections (e.g., components with vertical bore API connections).

Figure 23:
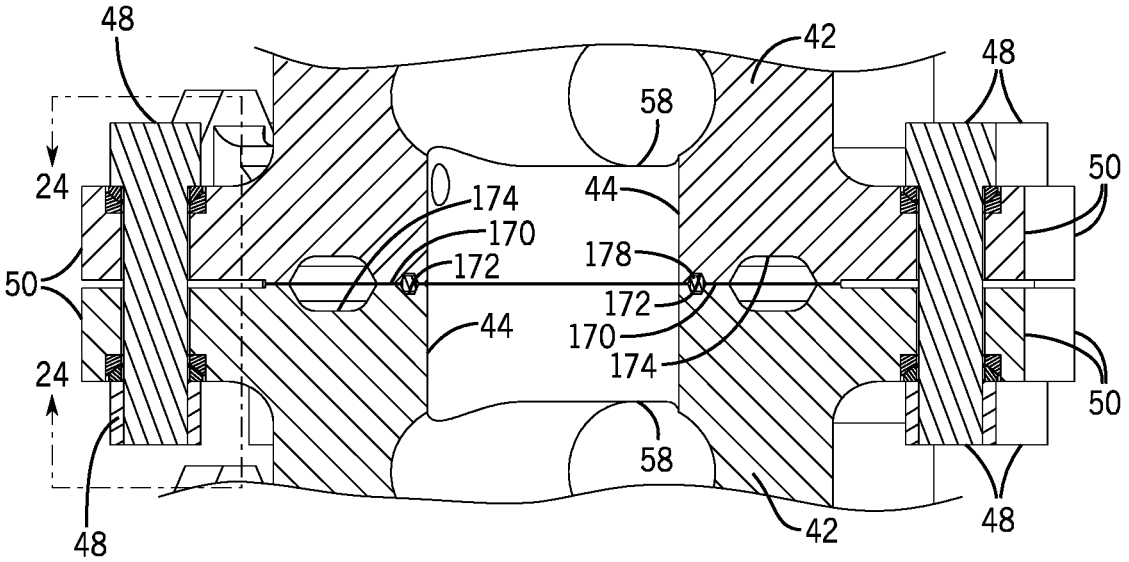

In many instances, nuts are used with bolts or studs to make-up a flanged connection. An example of this is shown in FIG. 23, in which fasteners 48 (shown here in the form of nuts and bolts) are used to connect the main bodies 42 via the wide flanges 50. In some instances, such as when there is a gap between a flange and a mating surface (e.g., a mating flange or studded surface), fasteners in flanged connections may be subject to bending loads. In the embodiment depicted in FIG. 23, the presence of the adjoining raised faces 170 cause the mating flanges 50 of the two main bodies 42 to be spaced apart. When the flanged connection is made-up (e.g., by tightening the nuts on the bolts), the flanges 50 can flex toward one another, causing bending stresses on the bolts. Such bending stresses may also be caused by external loading.

Figure 26:
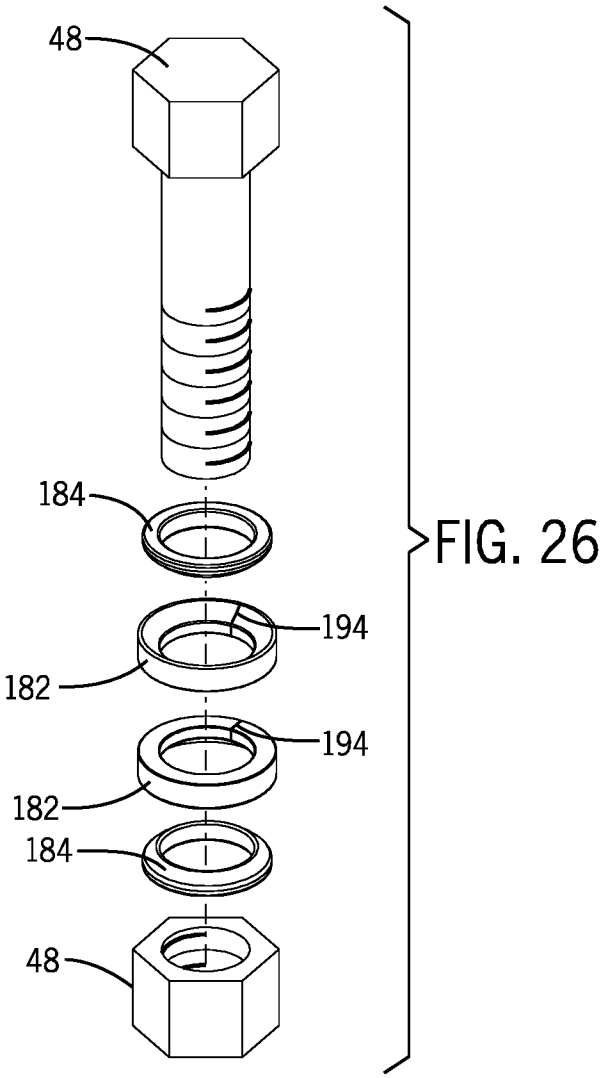
FIG. 26 is an exploded view of the fasteners and inserts of FIGS. 24 and 25.

In some embodiments, bending stresses on fasteners in a flanged connection are reduced through use of shaped elements that facilitate rotation of the flanges relative to the fasteners. By way of example, as generally shown in FIG. 23, the flanges 50 include shaped inserts to reduce bending stresses on the fasteners 48. Certain aspects of the inserts may be better understood with reference to FIGS. 24-26.

Figure 24:
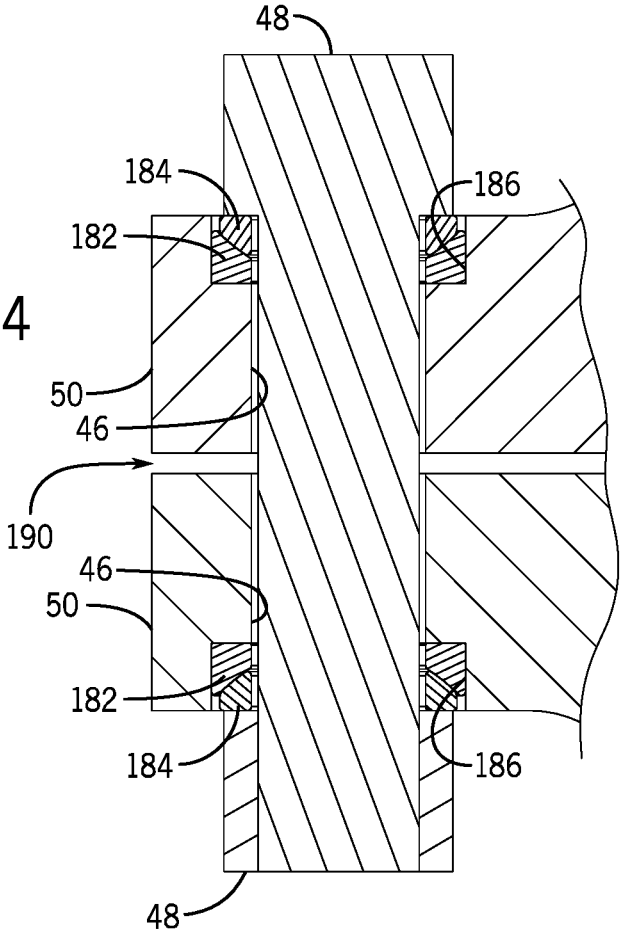
FIGS. 24 and 25 are detail views showing fasteners that connect flanges of the blowout preventers of FIG. 20 and inserts for reducing bending stresses on the connection in accordance with one embodiment.

In FIG. 24, inserts 182 and 184 are shown positioned within counterbores 186 of the fastening holes 46 in the flanges 50, which are separated by a gap 190. The inserts 182 and 184 bear against one another, with the inserts 182 having a concave bearing surface and the inserts 184 having a convex bearing surface. These bearing surfaces are shown in more detail in the exploded view of the fasteners and inserts in FIG. 26. As presently depicted, the mating surfaces of the concave inserts 182 and the convex inserts 184 are spherical, though either or both inserts may instead have a non-spherical bearing surface in other embodiments (e.g., non-spherical, tapered surfaces oriented to facilitate rotation of the flange with respect to a fastener). And while the concave inserts 182 are presently depicted as contacting the flange 50 with the convex inserts 184 contacting the fasteners 48, these inserts could be installed in the reverse order (i.e., with the inserts 184 contacting the flanges 50 and the inserts 182 contacting the fasteners 48).

Figure 25:
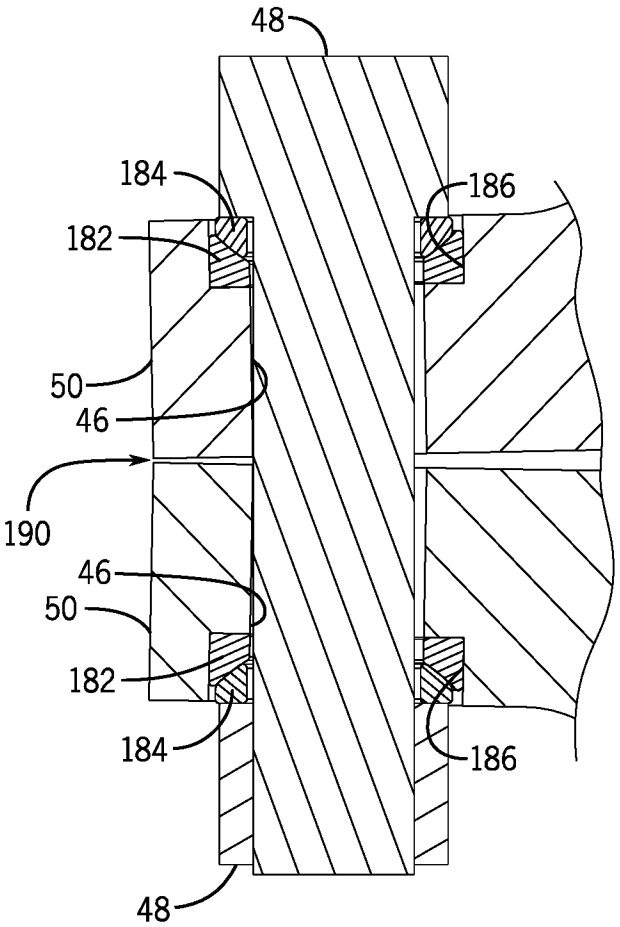

Upon loading of the bolted connection (whether from make-up, end loads, or other external loading) in a manner causing or increasing flexure of the flanges 50, the concave inserts 182 move with the flanges 50, which causes the concave inserts 182 to slide along and pivot about the convex inserts 184. An example of this is shown in FIG. 25, in which the bolted connection is deflected further than shown in FIG. 24. The extent of flexure of the flanges 50 in FIG. 25 is exaggerated for the sake of explanation and to better show the pivoting of the concave inserts 182 about the convex inserts 184 upon flexure of the flanges 50. This relative movement of the concave inserts 182 with respect to the convex inserts 184 allows the flange 50 to move relative to the fastener 48 (bolt or stud) extending through the holes 46 and reduces the magnitude of bending stresses transferred to the fastener. In at least some embodiments, the concave inserts 182 include splits 194 (FIG. 26) in one or more places to reduce hoop stresses on these inserts within the counterbores 186. The presently described inserts can be used to reduce bending stresses in bolted connections of various wide flange bodies, such as those described above. But the inserts can similarly be used in other flanged connections, including traditional flanged connections, to reduce bending stresses in full accordance with the present technique.

Additionally, while certain embodiments are described above as having external connection flanges 50 along the sides of ram cavity body portions of blowout preventers, and using fasteners 48 in the form of bolts and nuts to join preventers to each other or to other components via these flanges 50, other connection arrangements are also contemplated. For example, clamps (such as C-clamps) could be used, rather than bolts and nuts, to join flanges 50 together. In other embodiments, latches, clevis assemblies, keys, or a breech-lock connection could be used to join adjacent preventers, with or without flanges 50. In still another embodiment, the stackable blowout preventer bodies can have a tongue and groove arrangement to facilitate alignment and coupling of the preventers together.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A blowout preventer apparatus comprising:

a blowout preventer body including:

a bore extending axially through the blowout preventer body;

a ram cavity extending horizontally through the blowout preventer body and transverse to the bore;

opposing external end surfaces extending laterally to define the blowout preventer body and between which the ram cavity extends;

opposing external side surfaces extending horizontally between the opposing external end surfaces; and a plurality of external connection flanges extending laterally outwardly from each of the opposing external side surfaces;

wherein the opposing external end surfaces are devoid of external connection flanges.

2. The blowout preventer apparatus of claim 1, wherein the bore extends through the blowout preventer body from an upper surface of the blowout preventer body to a lower surface of the blowout preventer body, and the upper surface of the blowout preventer body or the lower surface of the blowout preventer body is a planar surface that includes a portion of one of the external connection flanges.

3. The blowout preventer apparatus of claim 2, wherein the planar surface is a rectangular planar surface.

4. The blowout preventer apparatus of claim 1, wherein each external connection flange has a bolt pattern that facilitates fastening of the blowout preventer body to another component.

5. The blowout preventer apparatus of claim 1, comprising:

rams positioned within the ram cavity; and bonnet assemblies coupled to the blowout preventer body, wherein the bonnet assemblies include operating pistons coupled to the rams.

6. The blowout preventer apparatus of claim 1, wherein the blowout preventer body does not include a tubular neck that extends from the blowout preventer body along a central axis of the bore.

7. The blowout preventer apparatus of claim 1, comprising a blowout preventer stack including the blowout preventer body and additional blowout preventer bodies structurally identical to the blowout preventer body, wherein the blowout preventer body and at least two of the additional blowout preventer bodies are fastened together via their external connection flanges.

8. A blowout preventer apparatus comprising:

a blowout preventer stack including:

a plurality of blowout preventers in a stacked configuration, the plurality of blowout preventers including a first blowout preventer with a first main body and a second blowout preventer having a second main body, the first main body and the second main body of the first and second blowout preventers each define a bore and a ram cavity configured to house rams, wherein the ram cavity extends horizontally and is transverse to the bore;

wherein a lower end of the first main body of the first blowout preventer defines a first lower flange and a second lower flange, wherein the first lower flange and the second lower flange are laterally separated from each other by the first main body and extend horizontally along opposed external side surfaces of the first main body between opposed external end surfaces of the first main body, wherein the opposed external end surfaces are devoid of flanges;

wherein an upper end of the second main body of the second blowout preventer defines a first upper flange and a second upper flange, the first lower flange and the second lower flange of the first main body of the first blowout preventer are fastened directly to the first upper flange and the second upper flange of the second main body of the second blowout preventer with a plurality of fasteners.

9. The blowout preventer apparatus of claim 8, wherein the lower end of the first main body of the first blowout preventer and the upper end of the second main body of the second blowout preventer each include a protrusion that extends laterally from the first main body and the second main body.

10. The blowout preventer apparatus of claim 8, wherein the first lower flange and the second lower flange are parallel to each other.

11. The blowout preventer apparatus of claim 8, wherein the first and second blowout preventers are fastened together via keyed engagement between the first and second blowout preventers.

12. The blowout preventer apparatus of claim 8, wherein the first main body and the second main body of the first and second blowout preventers are structurally identical to one another.

13. A method of assembling a blowout preventer stack, the method comprising:

aligning a first blowout preventer with a second blowout preventer into a blowout preventer stack, the first blowout preventer comprising a first main body and the second blowout preventer comprising a second main body, wherein the first main body and the second main body of the first blowout preventer and the second blowout preventer, respectively, have a modular design with a bore, a ram cavity, and a common size;

fastening respective bonnet assemblies to respective opposing external ends of the first main body and the second main body, wherein each of the respective bonnet assemblies comprises an operating piston coupled to a ram; and fastening the first blowout preventer and the second blowout preventer directly to one another with a plurality of fasteners that extend through flanges that extend laterally outward from and horizontally along respective opposing external sides of the first main body and the second main body between the respective opposed external ends of the first main body and the second main body, wherein the opposed external ends are devoid of flanges.

14. The method of claim 13, wherein the respective bonnet assemblies are pre-installed prior to fastening the first blowout preventer and the second blowout preventer directly to one another.

* * * * *